US005154628A

United States Patent [19]

Skegin

[11] Patent Number: 5,154,628

[45] Date of Patent: Oct. 13, 1992

[54] BAYONET-TYPE SOCKETS FOR HIGH CURRENT LAMPS

[76] Inventor: Maer Skegin, 1411 N. Poinsettia Pl., #206, Los Angeles, Calif. 90046

[21] Appl. No.: 816,619

[22] Filed: Dec. 31, 1991

[51] Int. Cl.[5] ..... H01R 4/50

[52] U.S. Cl. ..... 439/336; 437/671; 437/675; 437/700

[58] Field of Search ..... 439/335, 336, 667, 670–672, 439/700, 616, 613, 675

[56] References Cited

U.S. PATENT DOCUMENTS 2,283,934 5/1942 Jorgensen ..... 439/671
2,738,474 3/1956 Stube ..... 439/336
2,741,747 4/1956 Woofter ..... 439/671
3,569,907 3/1971 Landgraf ..... 439/336
4,099,820 7/1978 Delano ..... 439/336

*Primary Examiner*—Neil Abrams
*Assistant Examiner*—Hien D. Vu
*Attorney, Agent, or Firm*—Natan Epstein

[57] ABSTRACT

A bayonet type socket improved for handling heavy currents of Halogen bulbs has a socket shell with one or more rivet shaped electrical contacts carried by an insulating disc supported on a main spring in the shell. Each rivet contact is movable on the disc and is driven by an auxiliary spring against the base of the light bulb to ensure positive electrical contact. A superior ground connection is provided by a separate grounding element fitted on the socket exterior.

13 Claims, 3 Drawing Sheets

BAYONET-TYPE SOCKETS FOR HIGH CURRENT LAMPS

BACKGROUND OF THE INVENTION

1. Field of the Invention

This invention relates to the field of light bulb sockets and holders and in particular relates to lamp sockets of the bayonet type.

2. Background of the Invention

The need for better bayonet socket has become particularly acute with the advent and widespread use of Halogen type light bulbs which draw a considerably heavier current than earlier vacuum-filament incandescent bulbs. Whereas existing bayonet sockets may have been acceptable for use with the older lower current light bulbs, the high current demands of newer lamp bulb technologies call for improved sockets capable of reliably handling heavy currents without arcing and contact deterioration.

Bayonet type sockets for light bulbs are widely used and are characterized by a cylindrical shell which has a bottom at one end and is open at an opposite end. A disc of electrically insulating material in the shell carries one or more electrical contacts. The carrier disc is urged towards the open end by a spring supported on the bottom. The bulb base has laterally projecting detent pegs which make twist-lock engagement within corresponding detent slots in the socket shell for holding the bulb against the spring force, so that the electrical contacts on the carrier disc are urged against corresponding contacts on the bulb base when the bulb is inserted into the socket. The base of the socket shell has a central opening and a mounting for supporting the socket in a light fixture. The mounting may be a threaded stem or a bracket. One or more electrical wires pass through the bottom opening into the shell and are connected to each of the contacts on the insulated carrier for delivering electrical power to the light bulb. In one type of socket, the insulating disc carries a single contact which touches a center contact on the bottom of the bulb base. A return electrical path is provided by the socket shell itself which is metallic and makes contact with the metallic base of the light bulb through the detent pegs. In another type of socket, the insulating carrier supports two contacts which touch two corresponding contacts on the bottom of the bulb base, while the socket shell is not electrically connected to the power circuit and serves only a mechanical function for supporting the bulb.

In conventional bayonet sockets the contacts on the insulating carrier are metallic rivets with an elongated tubular stem mounted in a hole in the carrier disc, and a disc shaped head fixed to the upper end of the stem with a convex contact surface oriented towards the open end of the shell. The hollow stem of each contact element has a lower open end which receives the bare end of an insulated wire. The bare wire is inserted into the open end of the stem, and the stem is squeezed flat to clamp the wire inside the stem, thereby making both a mechanical and an electrical connection. At the same time, the flattened stem can no longer be pulled out of its mounting hole. The flattened stem is enlarged in diameter and cannot pass through the hole in the disc, which keeps the stem from moving through its mounting hole. Conventional practice is to flatten substantially the entire length of the stem which extends on the side of the carrier disc opposite to the contact head. This in effect, fixes the contact element in place on the insulated carrier disc, and keeps it from moving up and down through its mounting hole.

Light bulbs sockets of this type are frequently used with Halogen lamps, and often in outdoor lighting installations. Exposure to humidity and other environmental influences, whether indoors or out, tends to oxidize the contact surfaces of the socket and bulb. Corrosion gradually increases the contact resistance and has been found to eventually induce electrical arcing between the socket contacts and the bulb base contacts. The arcing in turn accelerates deterioration of the contact surfaces and may cause pitting until a marginal electrical connection exists which is wasteful of electrical power and reduces the quality of light produced by the bulb. In severe cases, the electrical contact may be interrupted altogether, causing the light fixture to fail.

In existing bayonet sockets a single, relatively large coil spring is compressed between the insulating carrier disc and the bottom of the socket shell. The purpose of the spring is to urge the contact or contacts on the carrier disc against the corresponding contacts on the lamp base. In practice, however it may happen that the force of the main biasing spring in the socket is largely absorbed by only one of the contacts which stops the carrier disc from adjusting as necessary to bring the other contact on the disc also firmly against the corresponding contact on the bulb base. It is easy for the carrier disc to become slightly tilted so that only one of the contact elements on the disc makes good contact with the bulb base. Also, considerable friction exists between the carrier disc and the socket shell, which can lock the disc in place, particularly after a period of use where the spring is continuously compressed at a particular position by the bulb base. This setting of the disc may keep it from adjusting to compensate for corrosion or arcing damage to the contact surfaces.

Deterioration of the sliding surfaces between the disc and the socket shell, or oxidation of the spring surfaces have a similar freezing effect on response of the carrier disc to changes in the contact surfaces. Poor electrical contact leads to electrical arcing and eventual burnout of the contact surfaces. This problem is common and a solution is needed to increase the reliability and service life of bayonet sockets for light bulbs, particularly when used under adverse environmental conditions.

BRIEF SUMMARY OF THE INVENTION

The present invention addresses the aforementioned shortcomings of the prior art by providing an improved bayonet type socket for light bulbs, where the socket is of the type having a socket shell with a bottom and an opposite open end, electrical contact elements on an insulating carrier, and a main spring urging the carrier disc towards the open end and into contact with the base of a bulb inserted into the socket shell. According to this invention, such conventional bayonet sockets are improved by providing secondary springs for individually urging each contact element on the carrier disc away from the carrier disc and towards the open end of the socket shell, thereby to separately bias each contact element into electrical contact with corresponding elements on the bulb base.

The improvement according to this invention is achieved in an economical and convenient manner by simple modification of the existing bayonet sockets. The existing socket is improved according to this invention using the rivet-type contact elements currently used in prior art bayonet sockets. These contact elements include an elongated, initially cylindrical hollow stem with an enlarged contact disc fixed to the upper end of the stem.

According to this invention, the electrical wire end is electrically and mechanically connected to the rivet contact and the contact element retained in its mounting hole by the same economical expedient used in existing sockets. This invention departs from the prior art in that a substantial length of the stem contiguous to the contact disc or head is preserved in its original cylindrical condition, and the stem is flattened only in a region near the open end of the stem. This modification permits the contact element to move axially, along the longitudinal dimension of the stem, within its mounting hole in the carrier disc. The contact element is nevertheless secured against separation from the disc by the flattened end of the stem which is of increased diameter and will keep the end from passing through the mounting hole. The improved socket is further modified by providing a secondary coil spring about the stem of each contact element, the spring being captive between the contact head and the carrier disc, to normally urge the contact head of each element up and away from the carrier disc. Each of these secondary springs provide individual biasing to the contact element or elements on the carrier disc to supplement the biasing force provided by the main spring of the socket. The smaller secondary springs are better able to respond to very small, slowly evolving changes in each of the contacting surfaces of the contact elements and the lamp bulb base. The secondary springs are desirably chosen so that they are not overpowered and fully compressed by the force of the main spring.

The various component parts used in conventional bayonet sockets have rather loose manufacturing tolerances which allows each contact element some freedom to move sideways within its mounting hole on the carrier disc. This freedom of lateral movement is enhanced in the improved socket of this invention by the fact that the stem portion is not firmly fixed to the carrier disc by deformation immediately adjacent to the underside of the carrier disc.

A further improvement according to this invention replaces the electrical ground connection, normally made between the socket shell with the bulb base, with an external spring-loaded ground contact element which is fitted onto the exterior of the socket shell on the base of the shell. In socket having the threaded stem, the ground contact element is held in place by a nut threaded on the stem. The stem and the nut are normally used in conventional sockets for mounting the socket to a light fixture or housing. The existing stem and nut are used in this invention for also securing an external spring contact which preferably is in the form of a ring adapted to fit over the stem with a number of radially extending spring arms with end contacts which project into the socket shell for making contact with the base of a bulb inserted into the shell. Where the external ground contact is used, the socket shell may advantageously be made of non-metallic, non-conductive material, such as a suitable plastic, with superior weather resistant properties, while the spring force of the external ground contact assures a better ground connection with the bulb base. Preferably, both the interior contact elements on the insulated carrier, as well as the external ground contact, are silver plated for lower resistance electrical contact and enhanced resistance to arcing and corrosion.

While the invention is described in connection with a socket having a threaded base stem, the improvements described herein are equally useful with sockets having a base mounting bracket instead of a threaded stem. The exterior ground contact can be retained to the socket shell by convenient means other than the mounting nut on the stem in such cases. These and other advantages of the present invention will be better understood by reference to the following detailed description of the preferred embodiments taken together with the attached drawings.

DETAILED DESCRIPTION OF THE PREFERRED EMBODIMENTS

Figure 1:
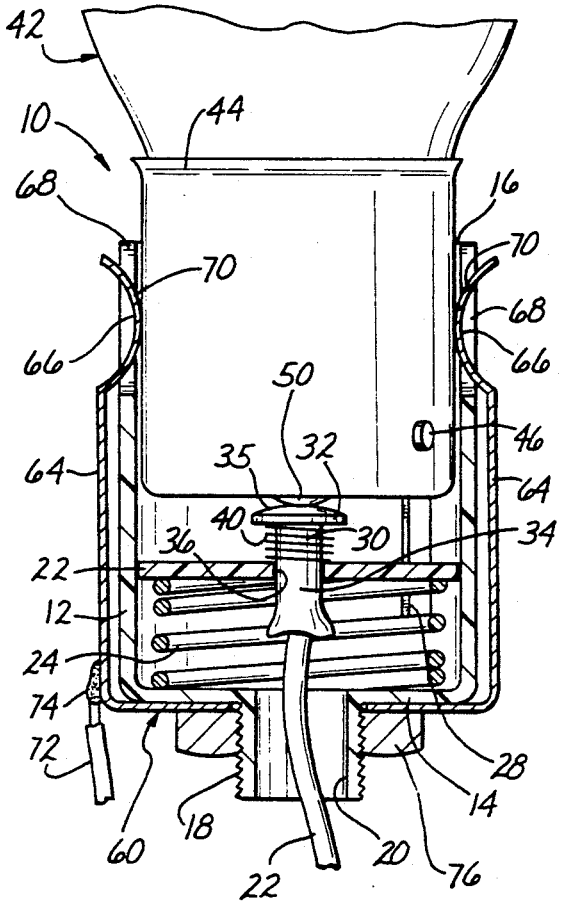
FIG. 1 is an elevational cross-section of a first form of the improved lamp socket taken along line 1—1 in FIG. 3, shown with a bulb inserted into the socket.

With reference to the drawings, FIG. 1 shows the improved lamp socket generally designated by the numeral 10. A socket shell 12 defines a cylindrical cavity with a bottom 14 and an opposite open end 16. A threaded stem 18 is centered on the outside of the shell bottom 14 and a center hole 20 in the bottom through the stem 18 admits an electrical conductor 25 into the shell 12. A carrier disc 22 of electrically insulating material has a diameter slightly undersized to the inside diameter of the socket shell 12, and is supported on a main spring 24 which in turn rests on the bottom 14 of the shell. Opposite radial tabs 26 on carrier disc 22, shown in FIGS. 2 and 3, move in longitudinal slots 28 cut in the side wall of the shell 12, to guide the carrier disc in axial displacement between a normal condition shown in FIG. 2 and a depressed condition seen in FIG. 1. The radial tabs also keep the disc 22 from turning within the socket shell. A contact element 30 centered in the disc 22 is a rivet-like element with a round flat head 32 supported on an elongated hollow cylindrical stem 34. The stem 34 fits in a mounting hole 36 centered in the carrier disc 22. The lower end of the stem 34 is open to receive the bare end of the electrical conductor wire 25. The wire end is held in the stem end by crushing the cylindrical stem end to a flattened condition, as best seen in the cross section of FIG. 7. The bare wire end 23 is mechanically fixed in the crushed stem end 38 and at the same time makes electrical contact with the element 30. The crushed portion of the stem is limited to a section adjacent to the open end of the stem, leaving a major portion of the stem 34 between the head 32 and the flattened open end 38 in its original cylindrical shape. The flattened end 38 of the stem has a diametric dimension, in the plane of the flattening, which is greater than the diameter of the mounting hole 36 of the contact element 30. The contact element is consequently held captive to the carrier disc 22, but is free to move through the hole 36 along the length of the undeformed portion of the stem 34, between the head 32 and the flattened end 38.

Figure 2:
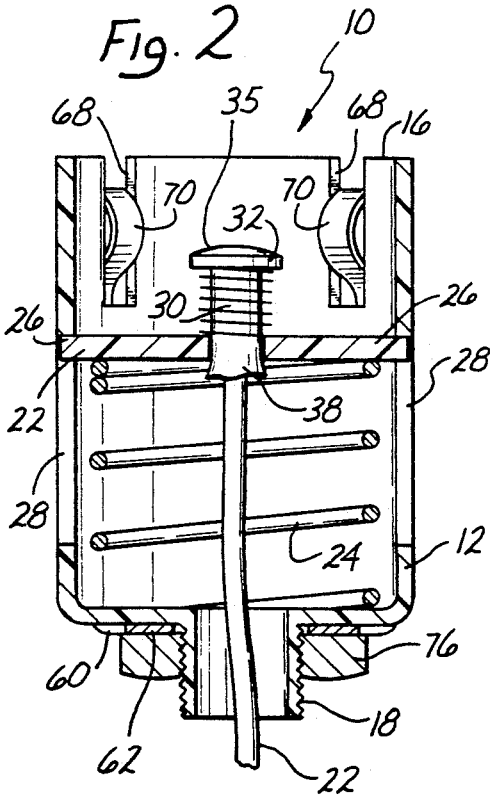
FIG. 2 is an elevational cross-section of the socket taken along line 2—2 in FIG. 3 without a bulb in the socket.
Figure 3:
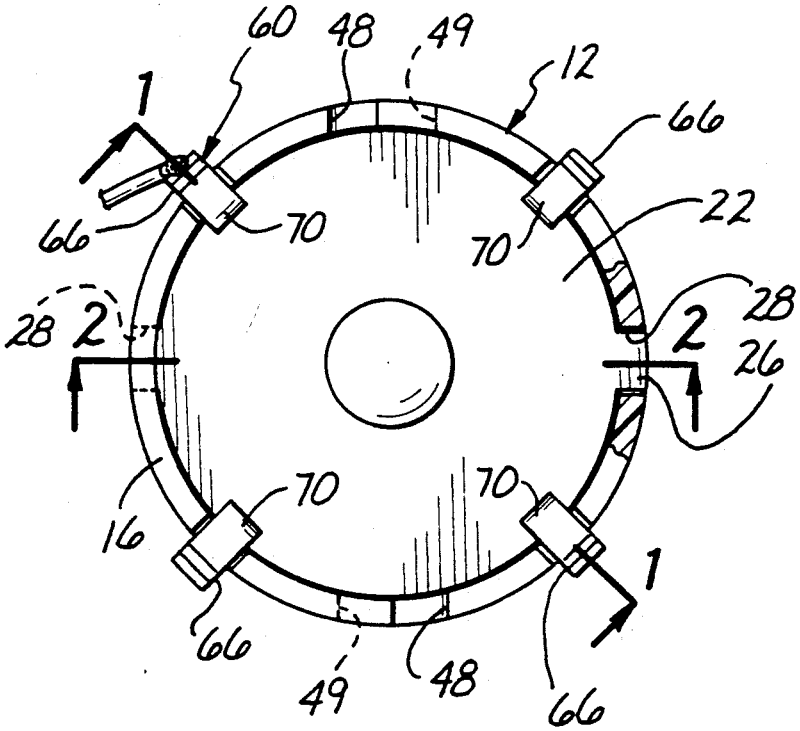
FIG. 3 is an end view of the socket of FIG. 2 seen from its open top end.
Figure 7:
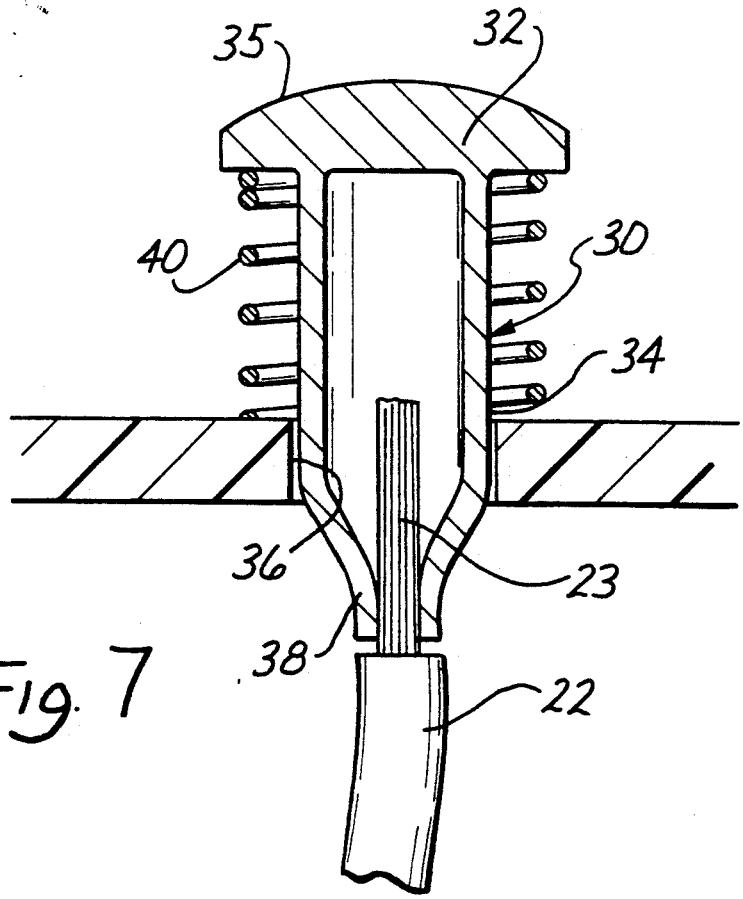
FIG. 7 is an elevational cross section of the rivet shaped contact supported on the insulating disc in the socket.

An auxiliary coil spring 40 around the stem 34 is captive between the carrier disc 22 and the head 32 of the contact element 30. The auxiliary spring 40 normally urges the head 32 away from the top side of the carrier disc 22, to an elevated position as seen in FIGS. 2 and 7.

Figure 4:
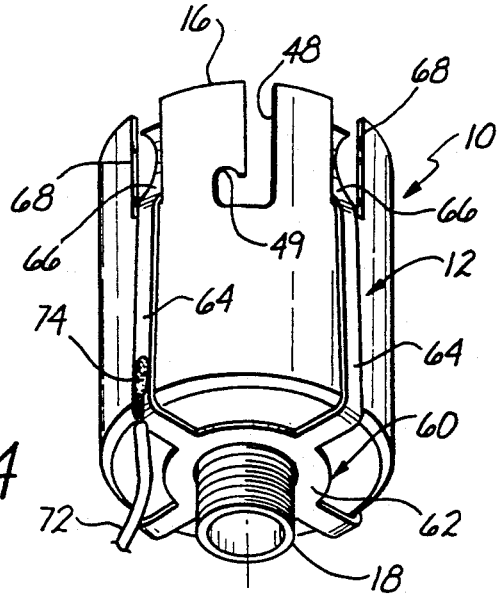
FIG. 4 is a perspective view showing the external ground contact mounted on the threaded stem at the bottom of the socket.

Turning to FIG. 1, a typical light bulb 42 has a cylindrical bulb base 44 with diametrically opposed radial detent pegs 46. The lamp bulb 42 is fitted to the socket 10 by inserting the base 44 into the shell 12 with the detent pegs 46 aligned in slots 48, best seen in FIGS. 3 and 4. An electrical contact 50 is centered on the bottom of the bulb base 44 and makes mechanical and electrical contact with the domed top surface 35 as the base is inserted into the shell 12. Downward force is transmitted through the auxiliary spring 40 to the carrier disc 22 and then to the main spring 24. The auxiliary spring 40 is selected so that the main spring 24 can be compressed in this manner to a condition illustrated in FIG. 1 without fully compressing the auxiliary spring 40 when pushing down on the contact head 32. The bulb base 44 is pressed down into the shell 12, partially depressing the contact element 30 relative to the carrier disc 22 by partially compressing the auxiliary spring 40, and also depressing the carrier disc 22 towards the bottom 14 by partially compressing the main spring 24, as shown in FIG. 1. Each detent peg 46 moves down to the bottom of a corresponding slot 48 in the socket shell, at which point the bulb 42 is twisted to move the pegs 46 sideways and into detent notch 49 in each slot 48 to make a twist lock engagement of the base 44 to the shell 12, which holds the bulb base 44 in place against the combined bias of the main spring 24 and auxiliary spring 40, both of which are held in a partially compressed state between the bulb contact 50 and the bottom 14 of the socket, a condition illustrated in FIG. 1. The auxiliary spring 40 applies a bias dedicated to ensuring positive contact between the element 30 and lamp contact 50 to compensating for minute gaps or films created by oxidation, corrosion or arcing processes during the operating life of the bulb/socket assembly.

The ground connection of the bulb 42 is made by contact of the lamp base 44 through the detent pegs 46 with the socket shell 12, which in prior art sockets is metallic and has a ground wire soldered directly to the shell. An improved ground connection is provided according to this invention by an external grounding element 60, which has a central annular portion 62 which fits around the threaded stem 18, and four radial arms 64 spaced at 90 degrees around ring 62. Each arm 64 has a horizontal portion which is co-planar with the ring 62 and a vertical portion which extends longitudinally along the cylindrical side wall of the shell 12, and terminates in a curved contact 66. The contact 66 projects into the interior of the shell 12 through a corresponding end slot 68 in the shell. The contacts 66 have convex inner surfaces 70, which are urged radially inwardly by the resilience of the arms 64 and yield outwardly in sliding contact as the bulb base 44 is inserted into the shell 12, maintaining a positive sliding contact with the bulb base. The multiple contact surfaces 70 provided by the grounding element 60 provide a superior ground connection than that available in prior art bulbs where the ground contact is mainly achieved by the detent pegs 46 touching the edge of the notch 49. This minimal contact area in prior art sockets is inadequate for carrying the heavy currents required by Halogen bulbs and has led to the same type of arcing and contact surface damage described in connection with the interior contact elements in prior art sockets. This problem is overcome by the grounding element 60. Whereas in prior art sockets a ground wire was soldered directly to the outside of a metallic shell, in the improved socket 10 of FIGS. 1–4 a ground wire 72 is soldered at 74 to one arm 64 of the grounding element 60. Of course, the soldered joint 74 can be made at other locations on the grounding element 60. The grounding element is secured on the shell 12 by a nut 76 which threads onto the stem 18 and captures the ring 62 in an interference fit against the bottom 14 of the socket shell.

Figure 5:
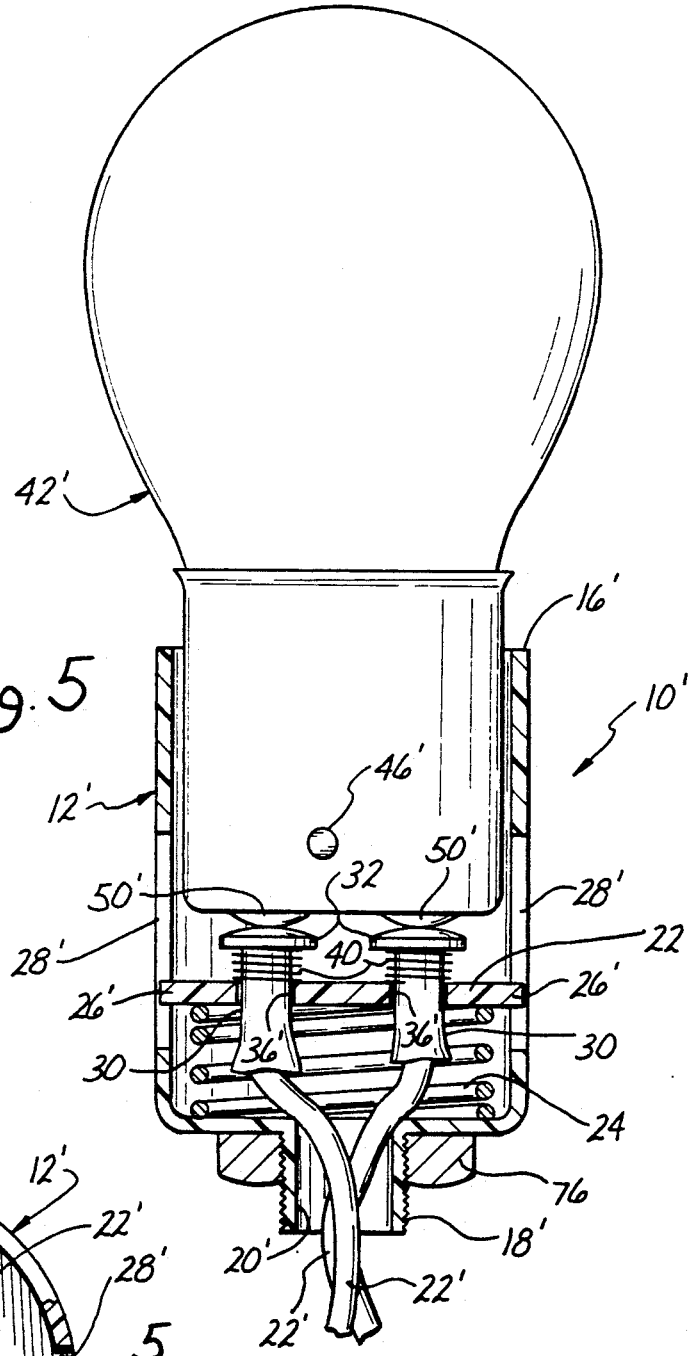
FIG. 5 is an elevational cross-section taken along line 5—5 in FIG. 6 showing a second form of the improved socket with two interior contacts and with a bulb inserted into the socket.
Figure 6:
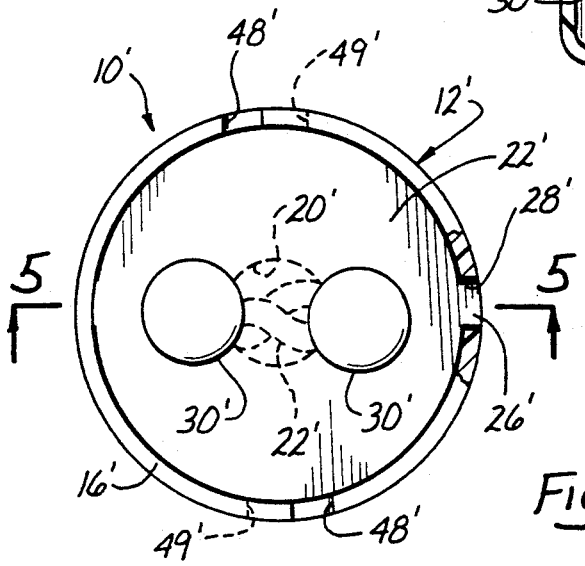
FIG. 6 is an end view looking into the open upper end of the two-contact socket of FIG. 5.

FIGS. 5 and 6 illustrate a second form of the improved socket 10' wherein primed numerals correspond to unprimed numerals in FIGS. 1–4. The socket 10' differs from socket 10 in that two contact elements 30' are carried on the disc 22', each in a corresponding mounting hole 36'. Instead of an external ground connection, the return electrical path or ground is provided by a second internal contact element 30'. Each contact element 30' in FIGS. 5 and 6 is as shown in FIG. 7 and is analogous to the single contact element 30 in FIGS. 1–3. Each contact element 30' in FIG. 5 is provided with a corresponding auxiliary spring 40 for purposes already described. No external grounding contact is needed in socket 10' and the socket shell 12 may be either electrically conductive or made of non-conductive material such as plastic. This second form 10' of the lamp socket is for use with lamp bulbs 42' which have two contacts 50' at the bottom bulb base. The two contacts 50' are aligned with the two contact elements 30' by the radial detent pegs 46' in the notches 49' of the socket shell, shown in FIG. 6. The carrier disc 22' is also fixed against rotation by radial tabs 26', as has been described, to keep the contact elements 30' in alignment with bulb contacts 50'.

If desired, the improved socket 10' of FIGS. 5 and 6 can be also provided with an external grounding contact, such as contact element 60 described in connection with FIGS. 1–4, for grounding of the bulb base, or for any other purpose.

While particular embodiments of the invention have been shown and described for purposes of clarity and example, it must be understood that many changes, substitutions and modifications can be made to the described embodiments by those possessed of ordinary skill in the art without thereby departing from the scope and spirit of the invention which is defined by the following claims.

What is claimed is:

1. An improved bayonet type socket for light bulbs of the type having a socket shell with a bottom and an opposite open end, electrical contact means on an insulating carrier in said shell, and first spring means urging said carrier towards said open end and into contact with the base of a bulb inserted into said shell, the improvement comprising second spring means normally urging said contact means towards said open end and away from said carrier.

2. The improved socket of claim 1 in which said contact means have a head portion and an elongated stem portion extending through a hole in said carrier, the improvement being characterized in that said stem is free for limited axial movement through said carrier and said head portion is urged away from said carrier towards said open end.

3. The improved socket of claim 2 wherein said second spring means is a compression spring acting between said head and said carrier, said second spring means being selected to be only partly compressed under the force of said first spring means.

4. The improved socket of claim 2 wherein said second spring means is a coil wound about said stem between said carrier and said head.

5. The improved socket of claim 1 wherein said shell is electrically nonconductive and the improvement further comprises ground contact means mounted exteriorly to said shell and projecting into said shell through apertures therein.

6. The improved socket of claim 5 wherein said socket has a threaded base stem and said ground contact means is retained to the shell by fastener means threaded on said stem.

7. An improved bayonet type socket for light bulbs of the type having a socket shell with a bottom and an opposite open end, two electrical contacts on an insulating carrier in said shell, each said contact characterized by a head portion and an elongated stem portion extending through said carrier, first spring means urging said carrier towards said open end and into contact with the base of a bulb inserted into said shell, and electrical wires connected to said contacts through an opening in said bottom, the improvement characterized in that said stem is free for limited axial movement through said carrier and comprising second spring means normally urging said head portion away from said carrier towards said open end.

8. The improved socket of claim 7 wherein said second spring means is a compression spring acting between said head and said carrier, said second spring means being selected to be only partly compressed under the force of said first spring means.

9. An improved bayonet type socket for light bulbs of the type having a socket shell with a bottom and an opposite open end, a threaded stem around an opening in said bottom, an electrical contact on an insulating carrier in said shell, said contact characterized by a head portion and an elongated stem portion extending through said carrier, first spring means urging said carrier towards said open end and into contact with the base of a bulb inserted into said shell, an electrical wire connected to said contact through said opening in said bottom, the improvement characterized in that:

said shell is electrically nonconductive, said stem is free for limited axial movement through said carrier and comprising second spring means normally urging said head portion away from said carrier towards said open end, and ground contact means mounted exteriorly to said shell and extending into said shell through side openings therein.

10. The improved socket of claim 9 wherein said second spring means is a compression spring acting between said head and said carrier, said second spring means being selected to be only partly compressed under the force of said first spring means.

11. The improved socket of claim 9 wherein said ground contact means is retained to the shell by fastener means threaded on said stem.

12. An improved bayonet type socket for light bulbs of the type having a socket shell with a bottom and an opposite open end, a threaded stem around an opening in said bottom, an electrical contact on an insulating carrier in said shell, said contact characterized by a head portion and an elongated stem portion extending through said carrier, first spring means urging said carrier towards said open end and into contact with the base of a bulb inserted into said shell, an electrical wire connected to said contact through said opening in said bottom, the improvement characterized in that:

said shell is electrically nonconductive, said stem is free for limited axial movement through said carrier and comprising a compression spring captive between said head and said carrier normally urging said head portion away from said carrier towards said open end, and a ground contact element mounted exteriorly to said shell and extending into said shell through side openings therein, said ground contact being retained to said shell by a nut threaded on said stem.

13. The improved socket of claim 12 wherein said ground contact element has a base apertured for mounting on said stem and a plurality of spring arms each terminating in a contact end urged radially into said socket by said arm through said side openings.

* * * * *